United States Patent [19]

Galvin

[11] 4,131,888

[45] Dec. 26, 1978

[54] DUAL PROJECTED-BEAM SMOKE DETECTOR

[75] Inventor: Aaron A. Galvin, Lexington, Mass.

[73] Assignee: American District Telegraph Company, New York, N.Y.

[21] Appl. No.: 715,405

[22] Filed: Aug. 18, 1976

[51] Int. Cl.[2] ..... G08B 17/10

[52] U.S. Cl. ..... 340/630; 250/575; 250/578

[58] Field of Search ..... 340/237, 416, 214; 250/575, 578, 573; 356/206, 207, 205, 51

[56] References Cited

U.S. PATENT DOCUMENTS

| | | | |
|---|---|---|---|
| 2,298,757 | 10/1942 | Evans et al. | 340/237 S |
| 2,715,720 | 8/1955 | Jenkins | 340/237 S X |
| 2,877,453 | 3/1959 | Mendenhall, Jr. | 340/237 S |
| 3,566,385 | 2/1971 | Lawson | 340/228 S |
| 3,634,839 | 1/1972 | Vassil | 340/237 S |
| 3,683,352 | 8/1972 | West et al. | 340/258 B |
| 3,723,746 | 3/1973 | Lawson et al. | 340/228.2 X |
| 3,811,781 | 5/1974 | Lowy | 356/51 X |
| 3,846,772 | 11/1974 | Peberdy | 340/227 R |
| 3,868,663 | 2/1975 | Ray | 340/237 S |
| 3,872,449 | 3/1975 | Scheidweiler | 340/237 S X |
| 3,919,702 | 11/1975 | Hayes et al. | 340/237 S |
| 3,922,656 | 11/1975 | Horvath et al. | 340/237 S |
| 3,924,252 | 12/1975 | Duston | 340/237 S |
| 3,982,130 | 9/1976 | Trumble | 250/373 |

*Primary Examiner*—John W. Caldwell, Sr.
*Assistant Examiner*—Daniel Myer
*Attorney, Agent, or Firm*—Weingarten, Maxham & Schurgin

[57] ABSTRACT

A smoke detector system including two projected beams operating in parallel, the outputs of which are processed to distinguish between outputs caused by smoke and outputs caused by other conditions affecting either or both beams. By comparing both the occurrence and the duration of reduced intensity outputs from the two beams, discrimination against false-alarm conditions is achieved.

13 Claims, 2 Drawing Figures

FIG. 2

| | A > 2 sec (56) | A > 20 sec (58) | B > 2 sec (60) | B > 20 sec (62) | Level (64) | Alarm Signal 52 (66) | Trouble Signal 54 (68) |
|---|---|---|---|---|---|---|---|
| 70 | 0 | 0 | 0 | 0 | 0 | 0 | 0 |
| 72 | 1 | 0 | 0 | 0 | 0 | 0 | 0 |
| 74 | 0 | 0 | 1 | 0 | 0 | 0 | 0 |
| 76 | 1 | 0 | 1 | 0 | 0 | 1 | 0 |
| 78 | 1 | 1 | 0 | 0 | 0 | 0 | 1 |
| 80 | 0 | 0 | 1 | 1 | 0 | 0 | 1 |
| 82 | 1 | 1 | 1 | 1 | 0 | 1 | 1 |
| 84 | 1 | 1 | 1 | 0 | 0 | 1 | 1 |
| 86 | 1 | 0 | 1 | 1 | 0 | 1 | 1 |
| 88 | X | X | X | X | 1 | 0 | 1 |

X = don't care

DUAL PROJECTED-BEAM SMOKE DETECTOR

FIELD OF THE INVENTION

This invention is concerned with smoke detection systems, and more particularly with projected-beam smoke detection systems containing circuitry for discrimination against false alarms.

BACKGROUND OF THE INVENTION

Of many devices available for the detection of smoke, the projected-beam type of smoke detector has several advantages over the more common types of smoke detector in which smoke is sensed within a chamber. A projected-beam detector provides very high sensitivity to even low smoke densities because of its ability to integrate over a relatively large volume of smoke; it provides the capability for covering a large area per device; and it provides quick response time because of the lack of resistance to smoke admittance which is inherent to chamber-type smoke detectors.

In spite of these advantages, projected-beam systems have disadvantages which have prevented their widespread acceptance. Projected-beam detectors are sensitive to alignment and must be carefully aimed on installation. Additionally, projected-beam detectors are more prone to false alarms caused by accidental beam blockage, such as by carelessly carried ladders, moths, or large buildups of dust on the optical components thereof.

SUMMARY OF THE INVENTION

The present invention provides a smoke-detection system including two projection-type detectors operating in parallel with one another. Broad transmitted beams and receivers with a wide angle of acceptance are used to reduce alignment problems. In the preferred embodiment the two transmitters are squarewave modulated in a quadrature relationship, and interference between the two beams is minimized by properly detecting the outputs from the two receivers. Alarm signals from the two receivers are processed by logic which compares the magnitudes and the durations of alarm signals from each of the beams with predetermined limits to sense and distinguish between alarm conditions, potential false-alarm conditions and trouble conditions.

DETAILED DESCRIPTION OF THE DRAWINGS

These and other advantages of the present invention will become more apparent upon reading the detailed description of the invention below and with reference to the accompanying drawings of which:

FIG. 2 is a truth-table useful in explaining the operation of the invention.

DETAILED DESCRIPTION OF THE INVENTION

Figure 1:
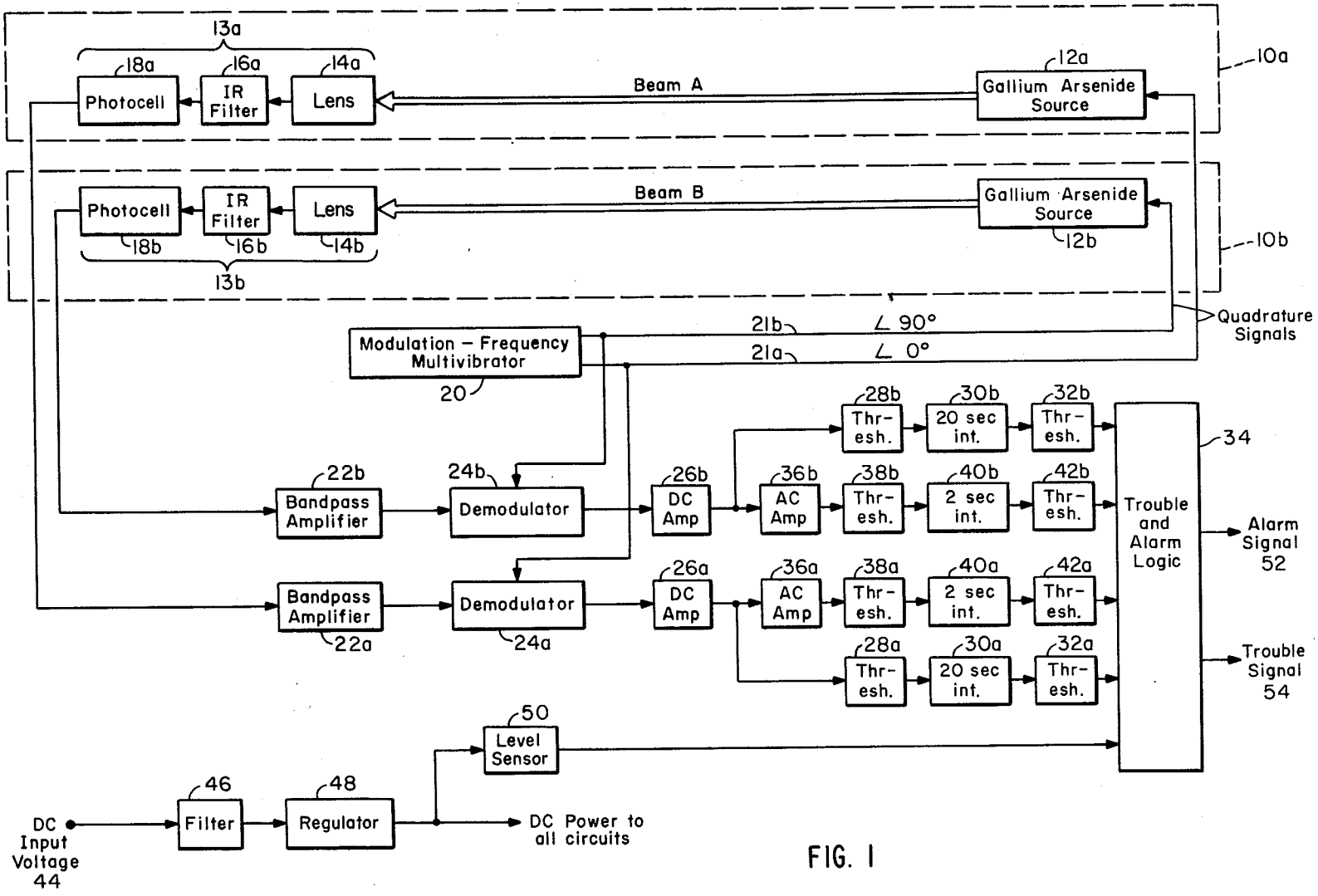
FIG. 1 is a block diagram of the invention.

Referring to FIG. 1, there is shown a block diagram of the invention. Central to the operation of the invention are two smoke-detection channels including projected-beam smoke detectors 10*a* and 10*b* and the electronics associated with each channel described below. Corresponding components of each channel are identified in the figures by the same numeral, the two channels being distinguished by the use of "a" or "b" following the numeral. Since the operation of each channel is essentially identical, the following description of operation is applicable to either channel, and the "a" and "b" designations will be used in the description only where necessary to distinguish between the two channels.

Each of the projected-beam smoke detectors 10 contains a source of illumination 12 which, as shown in FIG. 1, may typically be implemented using a gallium arsenide infrared diode. The illumination sources 12 each project beams of infrared radiation which traverse a path through the area to be protected by the smoke detector and which impinge upon receiver sections 13 of the projected-beam detectors 10. The receiver sections include lenses 14 which concentrate the received radiation. The outputs from the lenses 14 next pass through infrared filters 16 which eliminate variations in the transmitted radiation due to changing levels of visible radiation. The outputs from filters 16 are applied to photocells 18 in each of the parallel smoke detectors 10.

The maximum allowable distance between the infrared sources 12 and infrared receivers 13 in each of the detector channels is typically 200 feet. The present invention is provided with a relatively wide transmitted beam from source 12 coupled with a relatively wide received field of view in receiver 13, as determined by lenses 14, to obtain a measure of protection against misalignment. The two projected-beam smoke detectors 10*a* and 10*b* operate in parallel and are typically separated by approximately three feet. The use of such a dual-beam system in conjunction with the transmitting and receiving electronics described below serves to minimize false alarm signals which have been a major drawback to the use of projected-beam types of smoke detectors.

By properly modulating the two infrared sources 12*a* and 12*b* of each of the projected-beam channels 10*a* and 10*b*, and by properly demodulating the outputs from photocells 18, effects from stray radiation transmitted by one channel which impinges upon the receiver 13 of the other channel may be reduced or eliminated. This allows both the sources of infrared radiation 12 and the infrared receiving optics 13 to have a wider angle of transmittance and acceptance than would be otherwise possible, resulting in an increased tolerance to misalignment.

In a preferred embodiment, infrared sources 12*a* and 12*b* are modulated by quadrature signals from a multivibrator 20. The output from multivibrator 20 is typically a squarewave having a frequency of 2 kHz, although practically any frequency may be used. Two outputs 21*a* and 21*b* are provided by multivibrator 20, one applied to each of the infrared sources 12*a* and 12*b*. As indicated in FIG. 1, the signals to infrared sources 12*a* and 12*b* are separated by 90° of the modulation frequency and are thus in quadrature phase relationship with one another. By modulating the two infrared sources 12*a* and 12*b* of each of the projected-beam channels 10*a* and 10*b* in quadrature, stray infrared radiation from one channel which impinges upon the receiver 13 in the other channel may be cancelled by properly detecting the output from the photocell 18, as described below. Other methods of modulating the beams in the two channels, such as frequency modulation, may be used to provide similar cross-channel rejection performance. The angle of the beam transmitted by sources 12 is typically 5° or larger, and the angle of acceptance of receivers 13 is typically 5° or larger.

The outputs from photocells 18 are respectively applied to bandpass amplifiers 22. These amplifiers 22 serve to amplify the output signal from photocells 18 and to reduce extraneous noise from the output thereof via bandpass filtering. The outputs of bandpass amplifiers 22 are applied to demodulators 24.

The detection signal applied to demodulator 24*a* is the output signal 21*a* from multivibrator 20 having a phase angle of 0°. The modulation signal 21*b* of infrared source 12*b* and, hence, the radiation transmitted by source 12*b* are 90° out-of-phase with respect to signal 21*a;* and the radiation transmitted from infrared source 12*a* is in-phase with respect to signal 21*a,* as described above. By synchronously detecting the output of photocell 18*a* with signal 21*a* in demodulator 24*a,* any signals produced in photocell 18*a* due to stray illumination from infrared source 12*b* are 90° out-of-phase with the detection signal 21*a* and tend to be cancelled, while variations in the output of photocell 18*a* due to variations in the received illumination from infrared source 12*a* are in-phase with the detecting signal and are enhanced.

Similarly to the operation of demodulator 24*a,* demodulator 24*b* detects the output from photocell 18*b* with signal 21*b* from multivibrator 20 having a phase angle of 90°. In the same manner as described above, the operation of detector 24*b* tends to enhance components in the output of photocell 18*b* caused by changes in illumination in infrared source 12*b* and tends to cancel components in the output of photocell 18*b* caused by illumination from infrared source 12*a.*

The outputs from the demodulators 24 are applied to processing circuitry 26–42 for each channel, which operates in the following manner. The output from synchronous detector 24 is first amplified by a DC amplifier 26. The output from amplifier 26 is applied to a threshold circuit 28, the output of which is applied to an integrator 30; and the output of integrator 30 is in turn applied to a second threshold circuit 32. In response to a sufficiently large change in the illumination from source 12 detected by photocell 18, the output from DC amplifier 26 decreases by an amount sufficient to trigger threshold circuit 28. In response to this, threshold circuitry 28 starts the integration of integrator 30. If integrator 30 is not reset within 20 seconds, the output level of integrator 30 triggers threshold circuit 32; and the output of threshold circuit 32, which is applied to trouble alarm logic 34, goes high. If the output from DC amplifier 26 rises above the threshold determined by the threshold circuit 28 prior to the completion of the 20-second integration period of integrator 30, integrator 30 is reset, and the output from threshold circuit 32 remains low.

The output from DC amplifier 26 is also applied to AC amplifier 36. The output from AC amplifier 36 is applied to a threshold circuit 42 in a manner similar to the circuitry 28–32 following amplifier 26. This circuitry 36–42 produces an output which is applied to trouble and alarm logic 34 when the output from AC amplifier 36 exceeds the threshold set by threshold circuit 38 for a period greater than two seconds, as set by integrator 40.

The gains of the DC amplifier 26, AC amplifier 36, and threshold circuits 38 are such that the signal level from the synchronous detectors 24 required to trigger threshold circuits 38 is much lower than that required to trigger threshold circuits 28. Typically, a blockage of 2% or less per foot of the beam for beams of up to 22 feet and less than 1% per foot for long beams of up to 200 feet will trigger threshold circuit 38 while the level of threshold circuits 28 is typically set for 75% beam blockage or higher. Since the gain of the signal path through DC amplifier 26 and AC amplifier 36 is much higher than the gain through DC amplifier 26 alone, an output from the threshold circuits 32 associated with the outputs of DC amplifiers 26 is always preceded by an output from threshold circuits 42 associated with AC amplifier 36.

Threshold circuits 38 are AC coupled to the outputs from demodulators 24 via AC amplifiers 36 so that long-term changes in the output levels from receivers 13, caused, for example, by changes in the gain of the electronics or dust obscuring the detector optics, are rejected and do not cause false alarms. The time constants of AC amplifiers 36 are very long, being on the order of several minutes or longer.

Power for the circuitry is provided from a DC output voltage 44 which is filtered by a filter 46 and maintained at the desired level by a regulator 48. The output from regulator 48 is applied to the circuitry of the invention for the provision of power thereto. The output from regulator 48 is also applied to a level sensor 50 which serves to monitor the level of the output from regulator 48 and to provide a signal to trouble and alarm logic 34, should the output from regulator 48 fall below a predetermined limit.

Trouble and alarm logic 34 produces two outputs, an alarm signal 52 and a trouble signal 54. The presence of a positive alarm signal 52 indicates that the smoke detection system has determined that there is a high probability that smoke is actually present. The presence of a positive trouble signal 54 indicates that the smoke detection system has detected signal conditions indicative of a persisting potential false-alarm condition. Accidental blockages of the beam in detectors 10*a* and 10*b,* which are transitory in nature, are distinguished by trouble and alarm logic 34 and produce no alarm or trouble signal therefrom. As the vast majority of false alarm signals are transitory in nature, most conditions which otherwise would produce a false alarm will be disregarded by trouble and alarm logic 34 and thus do not even result in a trouble signal 52 being provided.

Referring to FIG. 2, there is shown a truth table describing the functioning of trouble and alarm logic 34 in producing the two output signals therefrom in response to the inputs applied thereto. Circuitry to perform such functioning may easily be constructed by one of ordinary skill in the art. Trouble and alarm logic 34 may be implemented, for example, by digital logic gates, a read-only memory, a properly programmed microprocessor, or by other means.

The column labels across the top of FIG. 2 denote the inputs to and outputs from trouble and alarm logic 34; and the "1's" and "0's" designate the presence or absence of the corresponding signal, a "0" indicating a low or negative signal and a "1" indicating the presence of a high or positive signal. The first column in FIG. 2, labeled 56, denotes the presence of a signal to trouble and alarm logic 34 from threshold circuitry 42*a,* indicating that the output from the "A" detector channel has exceeded the threshold set by threshold circuit 38*a* for longer than two seconds. The column labeled 58 denotes the presence of a signal from threshold circuit 32*a,* indicating that the output from channel A has exceeded the threshold set by threshold circuit 28*a* for longer than 20 seconds, as determined by integrator 30a. Similarly, columns 60 and 62 in FIG. 2 denote the corresponding signals from circuitry 26b–42b of channel B. Column 64 denotes the output signal from level sensor 50. The states of alarm signal 52 and trouble signal 54 in response to the corresponding inputs to trouble and alarm logic 34 shown in columns 56–64 is indicated in columns 66 and 68.

As indicated in row 70, in the absence of any positive inputs to trouble and alarm logic 34, both the alarm signal 52 and the trouble signal 54 are low. Disturbances detected by AC circuitry 36–42 and producing a "two-second" signal in one channel only are usually caused by an accidental blockage of the beam and are ignored by trouble and alarm logic 34, as shown in rows 72 and 74 of FIG. 2. The occurrence of such a distrubance in both channels simultaneously is indicative of the presence of smoke and produces an alarm signal 52, as shown in row 76.

Smoke blockages are usually on the order of a few percent of the beam, and the occurrence of both a two-second signal from threshold circuitry 42 and a 20-second signal from threshold circuitry 32 in the same channel indicates a solid object blocking the beam for a period of time that is more than transitory. In response to such an input indication, trouble and alarm logic 34 produces a trouble signal 54, as shown in rows 78 and 80.

While smoke detected by the projected beam detectors 10a and 10b is usually not sufficiently thick to cause activation of the circuitry 28–32 following the DC amplifiers 26, occasionally such thick smoke is produced by certain types of fires. The presence of such smoke would cause all four input signals to trouble and alarm logic 34 to be active simultaneously, as indicated in column 82. However, it is more frequently the case that such an input condition to trouble and alarm logic 34 is caused by an accidental blockage of both of the beams in the detectors 10a and 10b by some large object. Accordingly, in response to such an input condition wherein all four inputs are high, trouble and alarm logic 34 causes both trouble signal 54 and alarm signal 52 to be activated, as shown in row 82. In the event that both two-second and twenty-second signals are present in one channel and a two-second signal is present in the other channel, the alarm logic produces both alarm and trouble signals, as shown in rows 84 and 86.

Should the DC power to the circuitry of the invention fall below a predetermined limit, trouble and alarm logic 34 causes trouble signal 54 to be activated, regardless of the state of the other inputs, as shown in row 88.

The above description has presented an improved projected-beam type of smoke detector in which false alarm conditions to which previous projected-beam types of smoke detectors have been susceptible either are rejected or produce a trouble signal rather than an alarm signal. Various modifications will be obvious to those of ordinary skill in the art in applying the teachings of the present invention to different requirements. Accordingly, the present invention is to be limited only as indicated in the appended claims.

What is claimed is:

1. Apparatus for detecting the presence of smoke, comprising:

first and second detector channels, each including:

means for transmitting a beam of radiation over a path;

means for receiving the transmitted beam of radiation; and means for sensing a level of received radiation and for producing an intermediate signal representative thereof;

the paths of the beams of radiation in the first and second detector channels being substantially parallel; and alarm means to which are applied the intermediate signals from the first and second detector channels for producing an alarm signal in response to values of the intermediate signals indicative of the concurrent presence of smoke in the paths of both the first and second channels;

the sensing means further including:

first threshold means for determining when the level of the received radiation has decreased by a first percentage for a first predetermined duration and for producing an output signal indicative thereof; and second threshold means for determining when the level of the received radiation has decreased by a second percentage, larger than said first percentage, for a second predetermined duration, longer than said first predetermined duration, and for producing an output signal indicative thereof;

the alarm means further including:

means for providing an alarm signal in response to the presence of an output signal from the first threshold means of both first and second channels;

means for producing a trouble signal in response to the occurrence of an output signal from the second threshold means of either channel.

2. The apparatus of claim 1 wherein:

the first predetermined time is approximately 2 seconds; and the first percentage is approximately 2 percent or less per foot.

3. The apparatus of claim 1 wherein:

the first predetermined time is approximately 2 seconds;

the second predetermined time is approximately 20 seconds;

the first percentage is approximately 2 percent or less per foot; and the second percentage is 75 percent or more.

4. The apparatus of claim 3 wherein the radiation is infrared radiation.

5. Apparatus for detecting the presence of smoke, comprising:

first and second detector channels, each including:

means for transmitting a beam of radiation over a path;

means for receiving the transmitted beam of radiation; and means for sensing a level of received radiation and for producing an intermediate signal representative thereof;

the paths of the beams of radiation in the first and second detector channels being substantially parallel; and alarm means to which are applied the intermediate signals from the first and second detector channels for producing an alarm signal in response to values of the intermediate signals indicative of the concurrent presence of smoke in the paths of both the first and second channel;

the transmitting means of each of the channels further including means for modulating the transmitted beam of radiation; and the sensing means of each of the channels further including means for demodulating the received beam of radiation;

the transmitted and received beams of radiation being respectively modulated and demodulated in the first and second channels so as to reduce interference between the beams of radiation of the first and second channels.

6. The apparatus of claim 5 wherein:

the angle over which the beam of radiation is transmitted in each channel is larger than is required to illuminate the receiving means of each channel; and the receiving means has an angle of acceptance larger than is required to receive the transmitted beam of radiation;

whereby the tolerance to misalignment of the receiver and the transmitter of each channel is increased.

7. The apparatus of claim 5 further comprising:

an oscillator producing first and second output signals in quadrature phase relationship;

the first oscillator output signal being applied to the modulating means of the first channel and the demodulating means of the first channel;

the second oscillator output signal being applied to the modulating means and the demodulating means of the second channel;

the quadrature modulation and demodulation of the signals in the first and second channels serving to reduce effects from radiation transmitted by either channel which is received by the other channel.

8. The apparatus of claim 7 wherein:

the angle over which the beam of radiation is transmitted in each channel is greater than 5°; and the angle of acceptance of the receiving means in each channel is greater than 5°.

9. The apparatus of claim 7 wherein each of the detector channels further comprises:

first threshold means for determining when the received radiation has decreased by a first percentage for a first predetermined duration of time and for producing an output signal indicative thereof;

second threshold means for determining when the received radiation has decreased by a second percentage, larger than said first percentage, for a second predetermined duration of time, longer than said first predetermined duration, and for producing an output signal indicative thereof;

wherein the alarm means provides an alarm signal in response to output signals from the first threshold means of both channels;

and wherein the alarm means provides a trouble signal in response to output signals from the first and second threshold means of either channel.

10. The apparatus of claim 9 wherein the transmitted beam of radiation is infrared radiation.

11. A method for detecting the presence of smoke, comprising the steps of:

providing a first smoke detection channel by:

transmitting a first beam of radiation over a first path to provide a first smoke detection channel;

receiving the first beam of radiation and sensing the level of received radiation to produce a first intermediate signal representative thereof;

determining when the first intermediate signal representative of the level of received radiation has decreased by a first percentage for a first predetermined duration and providing a first output signal indicative thereof; and determining when the first intermediate signal representative of the level of received radiation has decreased by a second percentage, larger than said first percentage, for a second predetermined duration, longer than said first predetermined duration, and providing a second output signal indicative thereof;

providing a second smoke detection channel by:

transmitting a second beam of radiation over a second path substantially parallel to the first path, to provide a second smoke detection channel;

receiving the second beam of radiation and sensing the level of received radiation to produce a second intermediate signal representative thereof;

determining when the second intermediate signal representative of the level of received radiation has decreased by the first percentage for the first predetermined duration and providing a third output signal indicative thereof; and determining when the second intermediate signal representative of the level of received radiation has decreased by the second percentage for the second predetermined duration and providing a fourth output signal indicative thereof;

providing an alarm signal in response to the concurrent presence of first and third output signals in first and second channels; and providing a trouble signal in response to the occurrence of either of the second and fourth output signals.

12. The method of claim 11 wherein the steps of:

transmitting in each of the channels include modulating the transmitted beam of radiation; and sensing in each of the channels includes demodulating the received beam of radiation;

the transmitted and received beams of radiation being respectively modulated and demodulated in the first and second channels so as to reduce interference between the beams of radiation in the first and second channels.

13. The method of claim 11 further comprising the steps of:

producing first and second modulating signals in quadrature phase relationship;

modulating the transmitted beam of radiation in the first channel with the first modulation signal; and modulating the transmitted beam of radiation in the second channel with the second modulation signal; and wherein the step of sensing the level of the received radiation in the first channel includes demodulating the received radiation with the first modulation signal; and wherein the step of sensing the level of the received radiation in the second channel includes demodulating the received radiation with the second modulation signal;

the quadrature modulation and demodulation of the signals in the first and second channels serving to reduce effects from radiation transmitted by either channel which is received in the other channel.

* * * * *